US005413054A

United States Patent [19]

Collins

[11] Patent Number: 5,413,054

[45] Date of Patent: May 9, 1995

[54] PLASTIC CRADLE PALLET FOR LOADING, STORING AND TRANSPORTING HEAVY STEEL OR OTHER METAL COILS IN A VERTICAL POSITION

[76] Inventor: Eric H. Collins, Box 172, Pompton Plains, N.J. 07444

[21] Appl. No.: 82,789

[22] Filed: Jun. 28, 1993

[51] Int. Cl.[6] ..... B65D 19/44

[52] U.S. Cl. ..... 108/55.3; 108/55.5

[58] Field of Search ..... 108/51.1, 901, 53.1, 108/53.3, 55.1, 55.3

[56] References Cited

U.S. PATENT DOCUMENTS

| | | | |
|---|---|---|---|
| 3,315,800 | 4/1967 | Wagner | 108/55.3 X |
| 3,430,586 | 3/1969 | Oswald | 108/55.3 |
| 3,472,363 | 10/1969 | Lustin, Jr. et al. | 108/55.3 X |
| 3,507,415 | 4/1970 | Mankey | 108/55.3 X |
| 3,707,929 | 1/1973 | Lauffer | 108/901 X |
| 3,753,407 | 8/1973 | Tilseth | 108/55.3 |
| 4,796,540 | 1/1989 | Pelfroy | 108/901 X |

FOREIGN PATENT DOCUMENTS

| | | | |
|---|---|---|---|
| 1179153 | 10/1964 | Germany | 108/55.3 |

*Primary Examiner*—Jose V. Chen

[57] ABSTRACT

A One Piece Plastic Cradle Pallet is provided to enable the loading and transportation of coils of heavy steel or other metal in a vertical position. The cradle pallet is designed to nest with identical cradle pallets, in such a manner as to allow banding of a number of cradle pallets for ease of return shipment. Supporting legs are spaced apart, in such a fashion, as to allow two way entry of various lifting and handling device blades. Two safety walls are located on the outside top surface of the pallet, to provide added protection for personnel during loading and unloading procedures. The cradle pallet is manufactured by producing a Steel or Aluminum mold whose dimensions will allow for part shrinkage to the correct design dimensions. The mold is then used in the known art of rotational molding pV to produce an enclosed plastic hollow shaped cradle pallet. The hollow pallet is then encased in a steel fixture and filled in a separate known process with semi-rigid plastic foam. The finished cradle pallet can be of any color with molded in graphics for identification purposes. The pallet is UV (ultra-violet) stabilized to prevent deterioration from sunlight and can be utilized in temperatures ranging from 100° C. to minus 80° C.

3 Claims, 3 Drawing Sheets

PLASTIC CRADLE PALLET FOR LOADING, STORING AND TRANSPORTING HEAVY STEEL OR OTHER METAL COILS IN A VERTICAL POSITION

SUMMARY

This invention relates to an improved plastic cradle pallet for use in loading, storing and transporting heavy steel or other metal coils in a vertical position, The cradle pallet is capable of handling coils of various sizes up to a diameter of 36" and is nestable with identical pallets for ease of return shipment unloaded to the sender.

BACKGROUND OF THE INVENTION

Heavy coils of steel and other metals are presently stored and transported in a vertical position on wooden pallets. These pallets are, for the most part, made from oak and have a short life capability before breakage occurs. The availability and cost of using oak wood is an ever increasing problem. Return of wooden pallets, to the sender, for re-use is a problem due to the cost and availability of transport space. Likewise, disposal of broken wood pallets is a growing environmental problem. Metal and wood pallets have the added disadvantage of having connecting nails or bolts, sharp edges or splinters which can damage the coils and may be hazardous to personnel during the loading or unloading process. It follows from the foregoing that there is a need for a reusable one piece plastic cradle pallet to load and transport heavy steel and other metal coils, of various diameters, in a vertical position, that is capable of handling the heavy weight over a long period of time and can be available for re-use, by return shipment to sender, of pallets nested together to save space.

THE INVENTION

In accordance with the present invention, the problems described above can be essentially overcome by providing a one piece plastic cradle pallet, capable of loading and supporting heavy steel or other metal coils in a vertical position. The cradle pallet is intended to replace a total of twelve (12) different wooden pallets, presently used for storage and transportation of heavy steel and other metal coils in a vertical position. The one piece plastic cradle pallet is designed to accommodate coils varying in size from 36" outside diameter and 18" inside diameter to 26" outside diameter and 12" inside diameter. The one piece plastic cradle pallet is capable of nesting with other identical plastic cradle pallets, in such a manner, as to reduce shipping space required by 30%. Due to the weight and size of the steel and other metal coils, care must be taken, when loading, to fit the coils between the two cradle pairs of coil triangular supports, to ensure that they are positioned correctly, in respect to the vertical grooves and strapping holes utilized for strapping the coils in place. The one piece cradle pallet design allows for two way entry between the three legs for various lifting and handling device blades. Novel features of the plastic cradle pallet will be more readily understood from the accompanying drawings. Illustrating preferred adaptation of the invention in which various parts thereto have been identified with suitable reference characters in the various views and in which FIG. 1 is a side elevation view of the Plastic Cradle Pallet.

Figure 1:
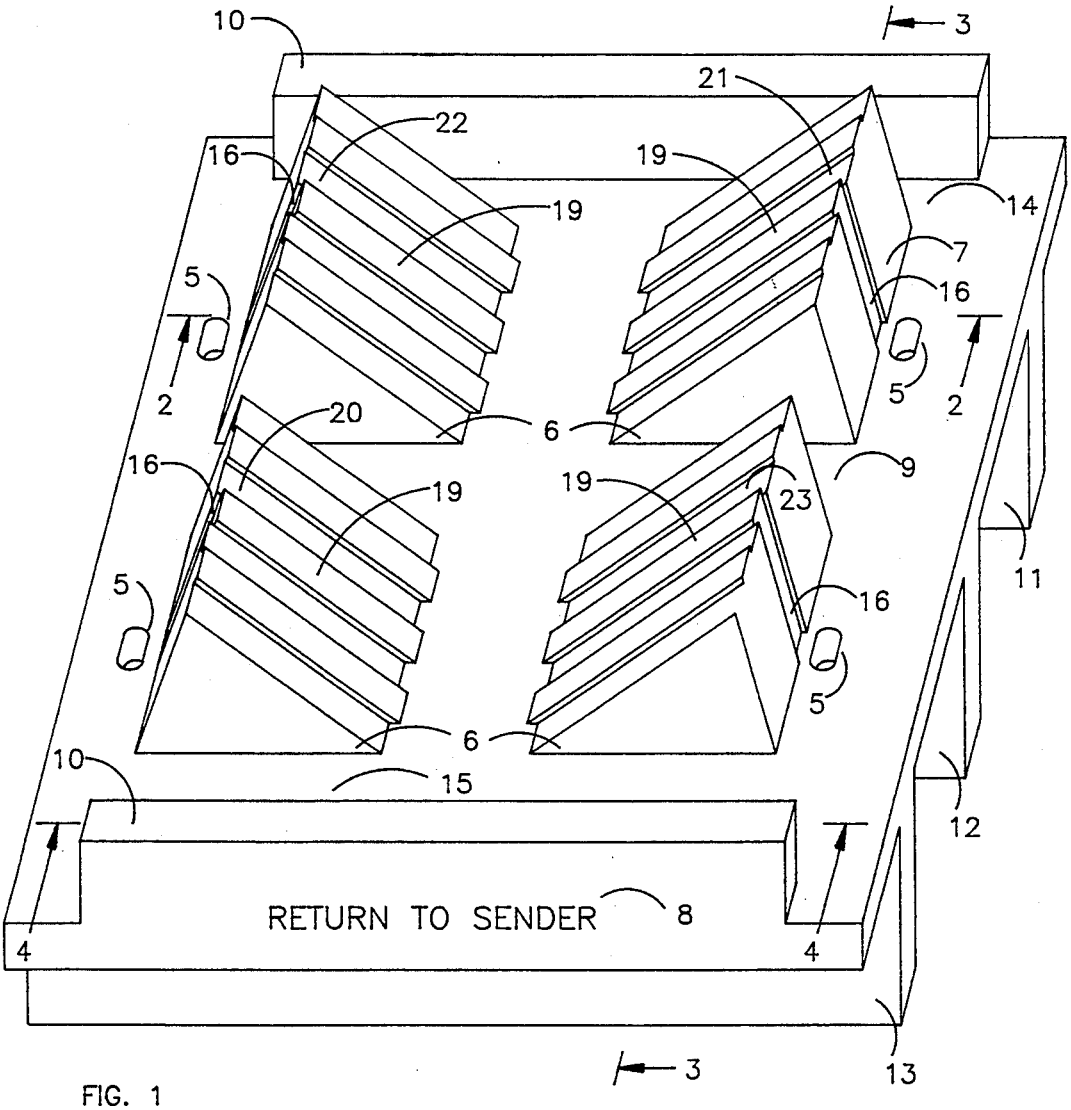
Figure 4:
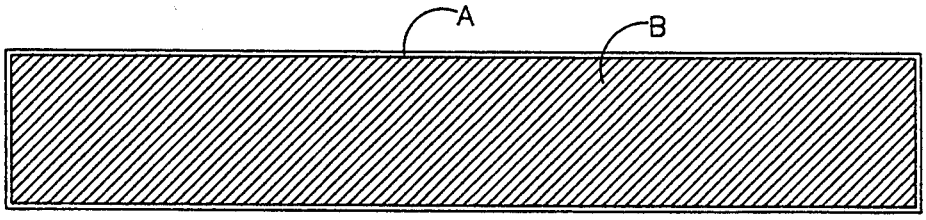
FIG. 4 is a sectional view substantially on the line 4.4 of FIG. 1.
Figure 6:
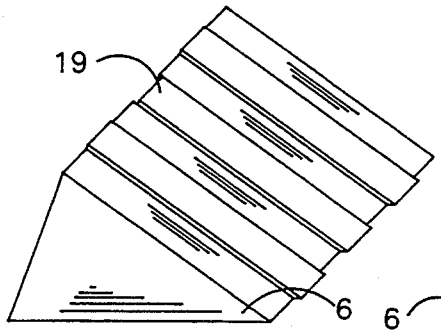
FIG. 6 is a side elevation view of the inner face of a triangular coil support shown in FIG. 1.
Figure 7:
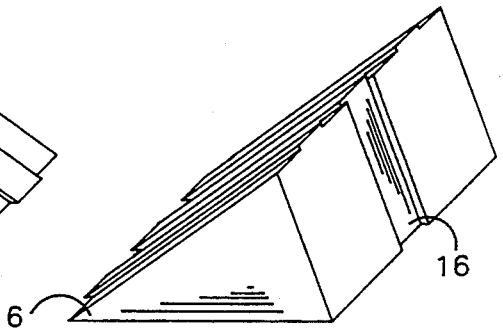
FIG. 7 is a side elevation view of the outer face of a triangular coil support shown in FIG. 1.

As shown in FIG. 1, the one piece plastic cradle pallet consists of 3 legs (11,12 and 13) extending the length of the pallet, spaced at a sufficient distance apart, to allow two way entry of various lifting and handling device blades. Two safety walls (10) are located on the top surface, at each end, extending partially across the length of the pallet. Four triangular coil supports (20, 21, 22 and 23) are located on the upper surface of the pallet. In FIG. 1 and FIG. 6, the inner supporting face of each triangular support is angled to the horizontal (6) and grooved (19) to provide greater coil stability. In FIG. 1 and FIG. 4, feed grooves (16) are located centrally on the exterior face to facilitate coil strapping. The triangular coil supports (20, 21, 22 and 23) positioned equidistant to one another around the center of the upper surface of the cradle pallet and located at a distance to form two cradle pairs, (20 and 23) and (21 and 22). Each cradle pair is capable of supporting a coil or coils of heavy metal up to 36" in diameter. The two cradle pairs, of triangular supports, are spaced apart (9) to enable the nesting of the center leg (12) of an identical pallet.

Figure 2:
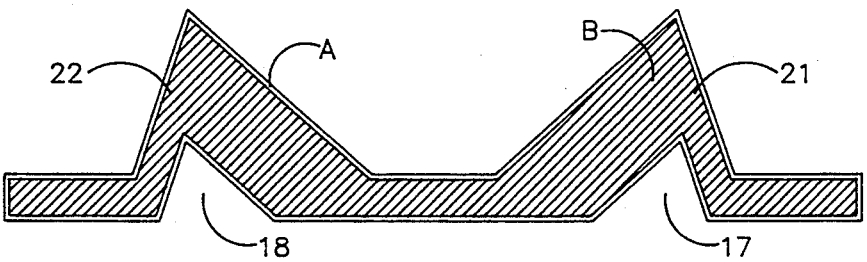
FIG. 2 is a section view substantially on the line 2.2 of FIG. 1.
Figure 9:
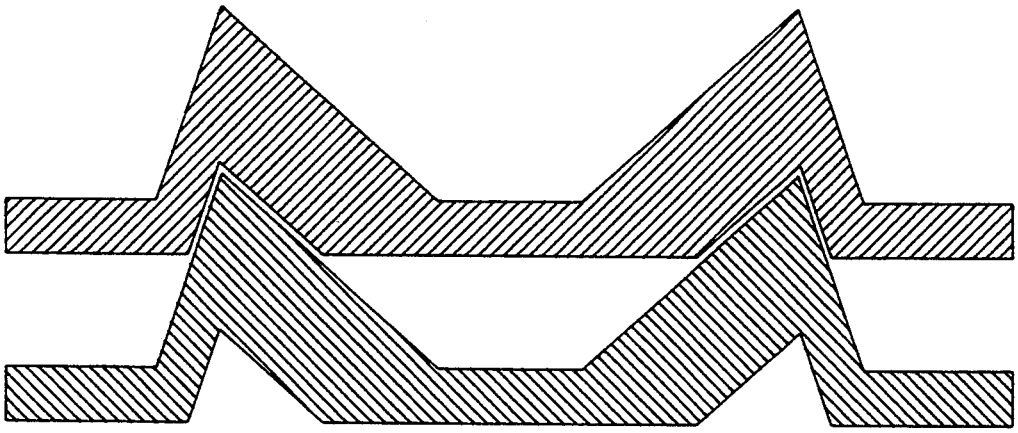
FIG. 9 is a section view on the line 2.2 of FIG. 1 of two cradle pallets nested together.

FIG. 2 a sectional view, across the length of a cradle pair of triangular coil supports, illustrates the triangular coil supports (21 and 22), on the upper surface of the pallet and indents on the bottom surface of the pallet (17) and (18), which can be nested with an identical pallet as shown in FIG. 9.

Figure 3:
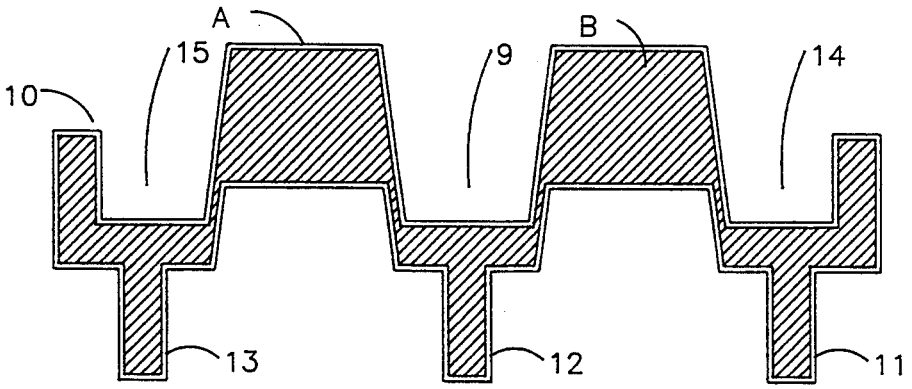
FIG. 3 is a sectional view substantially on the line 3.3 of FIG. 1.
Figure 8:
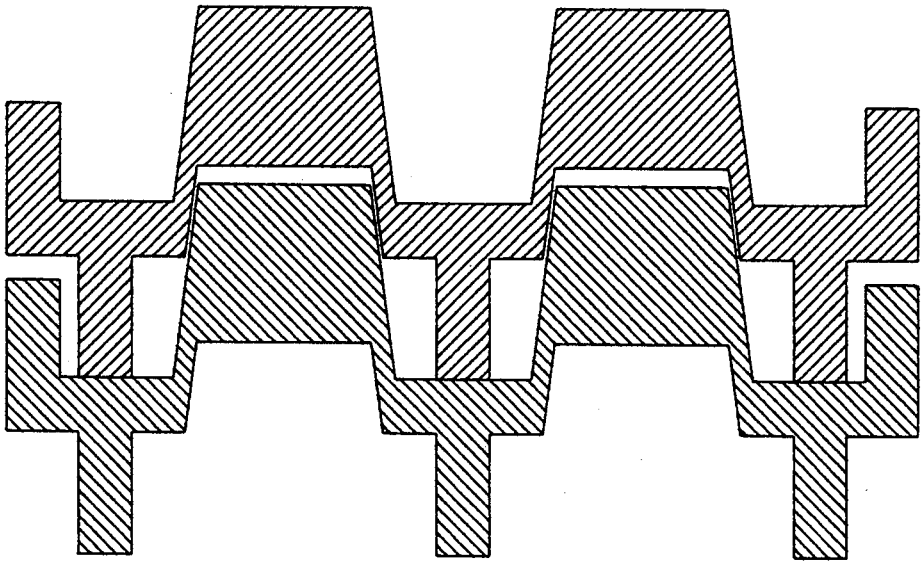
FIG. 8 is a section view on the line 3.3 of FIG. 1 of two cradle pallets nested together.

FIG. 3 a sectional view, across the width of the pallet, shows the three support legs 11, 12 and 13, which can be nested into spaces 14, 9 and 15 of an identical pallet, as shown in FIG. 8.

Figure 5:
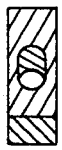
FIG. 5 is a fragmentary view of a strapping hole located at the base of a triangular coil support shown in FIG. 1.

Four strapping holes, (5) and FIG. 5, are provided at the base of the triangular coil support feed grooves (16), to allow the coils to be strapped in place within the cradle pairs of triangular coil supports. Strapping is achieved over the top of the coils down the feed grooves (16), through the strapping holes (5) and under the pallet between the legs. A molded in graphic (8) is added in the manufacturing process to promote the reusability of the pallet.

The one piece cradle pallet is manufactured by producing a steel or aluminum mold, whose dimensions will allow for part shrinkage. The mold incorporates all the features shown in FIG. 1, including the strapping holes. The hollow plastic part produced in polyethylene or similar plastic is manufactured in a known rotational molding process. A part is produced which is completely enclosed and hollow as shown in FIG. 2A, FIG. 3A and FIG. 4A. The hollow enclosed plastic part is then encased in a steel fixture and filled in a separate known process, with semi-rigid plastic foam, consisting of two components applied under pressure as shown in FIG. 2B, FIG. 3B and FIG. 4B.

I claim:

1. A one piece plastic cradle pallet for use in loading, storing and transporting heavy coils of steel or other metal in a vertical position, said pallet comprising:

a) three support legs, extending the length of the pallet, of such height and distance apart to allow for two way entry of a variety of lifting and handling device blades;

b) two safety walls located on the top surface edges of said pallet, partially extending along the length of said pallet;

c) four triangular coil supports, positioned on the top side of the upper surface of said pallet, located equidistant from the center of said pallet;

d) said four triangular coil supports forming two cradle pairs, each cradle pair capable of supporting a coil of steel or other metal, having grooved interior coil support walls facing each other, sloped at such an angle to the horizontal, being of such height above the top surface of said pallet and spaced at such a distance apart to limit coil contact to the middle portion of said sloped interior coil support walls;

e) said cradle pairs being located equidistant from the center of said pallet and at such a distance apart, to allow a middle support leg of an identical pallet to be placed between said two cradle pairs across the length of said pallet for nesting purposes;

f) said cradle pairs located, at a sufficient distance apart from said safety walls, on the upper surface edges of said pallet, to allow two outside support legs of an identical plastic pallet to be placed between said cradle pairs and the adjacent safety walls, across the length of said pallet for nesting purposes;

g) four triangular indents, located on the underside of the bottom surface of said plastic pallet, equidistant from the center of said pallet, positioned so as to correspond with and indent the bases, of said four triangular coil supports, between said support legs, each triangular indent having size and dimensions sufficiently greater than said triangular support upper portion size and dimensions, to allow four triangular coil supports, of an identical pallet, to be inserted into said four triangular indents, at such a depth, to allow said three support legs to rest on an identical pallets flat top side upper surface for nesting purposes; and h) four strapping holes located on the top upper surface of said pallet positioned adjacent to four feed grooves located centrally on said four triangular coil supports outer surface walls.

2. A plastic cradle pallet as defined in claim 1, wherein a known transfer process is utilized to transfer a molded in graphic to said pallet wall.

3. A plastic cradle pallet as defined in claim 1, wherein a method of manufacture is used, utilizing a combination of known processes a follows:

a) manufacture of a steel or aluminum mold whose dimensions will allow for part shrinkage of the plastic to the required shape and configuration;

b) utilizing said mold, in a molding process to provide an enclosed plastic hollow shaped cradle pallet; and c) encasing said plastic hollow shaped cradle pallet in a steel fixture and in a separate process filling said plastic cradle pallet under pressure with semi-rigid polyurethane.

* * * * *